US010624442B2

(12) United States Patent
Evans et al.

(10) Patent No.: US 10,624,442 B2
(45) Date of Patent: Apr. 21, 2020

(54) ADJUSTABLE HOLDER

(71) Applicant: Edge-Works Manufacturing Company, Burgaw, NC (US)

(72) Inventors: Scott V. Evans, Jacksonville, NC (US); Nicholas R. Tomczak, Richlands, NC (US)

(73) Assignee: Edge-Works Manufacturing Company, Burgaw, NC (US)

( * ) Notice: Subject to any disclaimer, the term of this patent is extended or adjusted under 35 U.S.C. 154(b) by 0 days.

(21) Appl. No.: 16/197,832

(22) Filed: Nov. 21, 2018

(65) Prior Publication Data

US 2019/0150600 A1 May 23, 2019

Related U.S. Application Data

(60) Provisional application No. 62/589,989, filed on Nov. 22, 2017.

(51) Int. Cl.
*A45F 5/02* (2006.01)
*A45F 5/00* (2006.01)

(52) U.S. Cl.
CPC ..... *A45F 5/021* (2013.01); *A45F 5/02* (2013.01); *A45F 2005/008* (2013.01); *A45F 2200/0566* (2013.01); *A45F 2200/0583* (2013.01); *A45F 2200/0591* (2013.01)

(58) Field of Classification Search
CPC . B62J 11/00; B62J 9/005; A45F 5/021; A45F 2200/0566; A45F 2200/0583; Y10S 224/926
See application file for complete search history.

(56) References Cited

U.S. PATENT DOCUMENTS 1,605,195 A * 11/1926 Lewis ..... A45F 5/00 224/148.6
3,369,723 A * 2/1968 Saari ..... A45F 5/02 224/148.6
4,006,851 A * 2/1977 Kippen ..... F41B 15/02 224/197
4,418,733 A * 12/1983 Kallman ..... B65D 33/14 116/209
4,485,946 A * 12/1984 Liautaud ..... A45F 5/021 224/196

(Continued)

*Primary Examiner* — Brian D Nash
(74) *Attorney, Agent, or Firm* — Stephen M. Kepper; Ian C. Barras; Intellectual Property Consulting, LLC

(57) ABSTRACT

The present invention describes an adjustable holder used primarily to secure substantially cylindrical objects to the person, clothing, or gear of a user. For the preferred embodiment, the holder is a substantially cylindrical casing comprising: a substantially curved front wall, the substantially curved front wall further comprising two portions and a helical opening, where the helical opening separates the two portions of the substantially curved front wall; an opposing back wall; a closed bottom end; an open top end; and an interior compartment wherein the substantially curved front wall is connected to the opposing back wall, the closed bottom is connected to both the substantially curved front wall and the opposing back wall, and the substantially curved front wall, the opposing back wall, and the closed bottom collectively form the interior compartment; and wherein the two portions of the substantially curved front wall are connected by the fastener.

12 Claims, 5 Drawing Sheets

(56) References Cited

U.S. PATENT DOCUMENTS 4,662,552 A * 5/1987 Uyehara ..... A45F 5/02 224/251
4,696,447 A * 9/1987 Strecker ..... A45D 20/12 248/206.3
4,848,625 A * 7/1989 Lucia ..... B62J 11/00 224/250
4,872,600 A * 10/1989 Corbin ..... A45F 5/02 224/245
5,007,566 A * 4/1991 Fick ..... B62J 11/00 224/414
5,145,138 A * 9/1992 Schlanger ..... B62J 11/00 224/414
5,170,981 A * 12/1992 Lin ..... B62J 11/00 224/414
D333,071 S * 2/1993 Lim ..... 224/250
5,232,137 A * 8/1993 Devine ..... A45F 5/02 222/175
D346,996 S * 5/1994 Blackburn ..... D12/411
5,386,961 A * 2/1995 Lu ..... B62H 5/00 224/425
6,145,715 A * 11/2000 Slonim ..... A47G 23/0225 224/148.3
6,286,798 B1 * 9/2001 Chun ..... A47G 23/0216 206/218
6,510,592 B1 * 1/2003 Hamilton ..... A44B 11/06 24/170
6,557,808 B1 * 5/2003 Ling ..... B62H 5/00 224/425
6,932,255 B2 * 8/2005 Van Houtte ..... B62J 11/00 224/414
7,748,583 B1 * 7/2010 Woltman ..... A45D 20/12 224/242
7,959,121 B1 * 6/2011 Barnes, Jr. ..... A47G 23/0225 224/148.4
8,083,112 B2 * 12/2011 Kuo ..... B62H 5/00 224/425
8,919,623 B1 * 12/2014 Bergeron ..... A45F 5/02 224/148.4
9,115,887 B2 * 8/2015 Chuang ..... F21V 33/008
9,345,353 B2 * 5/2016 Forbes ..... G09F 21/04
9,862,445 B2 * 1/2018 Chuang ..... B62J 9/02
10,131,393 B2 * 11/2018 Chuang ..... B62J 9/02
2006/0065689 A1 * 3/2006 Johnson ..... A45F 5/02 224/675
2006/0261019 A1 * 11/2006 Chao ..... A45F 3/18 211/74
2010/0084531 A1 * 4/2010 Schuchman ..... A47G 23/0225 248/311.2
2010/0294816 A1 * 11/2010 Sentell ..... A45F 5/02 224/148.3

* cited by examiner

ADJUSTABLE HOLDER

RELATED APPLICATIONS

This application claims priority to U.S. Provisional Application No. 62/589,989 filed Nov. 22, 2017. The entire contents of the above application are hereby incorporated by reference as though fully set forth herein.

FIELD

The present invention relates in general to devices designed for the holding of objects. More specifically, the present invention relates to devices designed to retain and secure substantially cylindrical objects to the person, clothing or gear of a user.

BACKGROUND

In a tactical environment or situation, or training or sporting activity, the need of the operator, soldier, law enforcement officer, civilian sportsman or other user to carry various gear on one's person, in support of the mission or activity, is always present. As such users are continually searching for improved methods and items to carry their gear. Such improvements often include features that increase the amount of gear being carried through a more efficient use of space, modularity in using and arranging such gear specific to a user's needs and improved accessibility to said gear while maintaining a reasonable (and sometimes adjustable) level of security in carrying such items. Many items in these fields are cylindrically shaped, including but not limited to: flashlights, batons, flash bangs, hand grenades, batteries, scopes or other aiming devices, or any other items of substantially cylindrical shape that may be useful for their task.

Devices for the retention and quick-release of cylindrically shaped objects to a person are known in the prior art and generally consist of either an encasing that allows the cylindrically shaped body to snap into a secure setting or includes a mold that is customized to fit the body of a particular object while being secured by a strap. Both prior art designs have limitations, namely the inability to adjust and accommodate objects of various sizes.

As such, there is a need for an adjustable holding device that has the flexibility to accommodate and secure various cylindrically shaped objects with differing diameters.

BRIEF SUMMARY OF THE INVENTION

It is the object of the present invention to address several challenges in previous attempts to create a quick access holding device that can accommodate substantially cylindrical objects of various diameters. The device comprises a substantially cylindrical casing comprising: a substantially curved front wall, the substantially curved front wall further comprising two portions and a helical opening, where the helical opening separates the two portions of the substantially curved front wall; an opposing back wall; a closed bottom end; an open top end; and an interior compartment wherein the substantially curved front wall is connected to the opposing back wall, the closed bottom is connected to both the substantially curved front wall and the opposing back wall, and the substantially curved front wall, the opposing back wall, and the closed bottom collectively form the interior compartment, and wherein the two portions of the substantially curved front wall are connected by the fastener.

DETAILED DESCRIPTION

Figure 1:
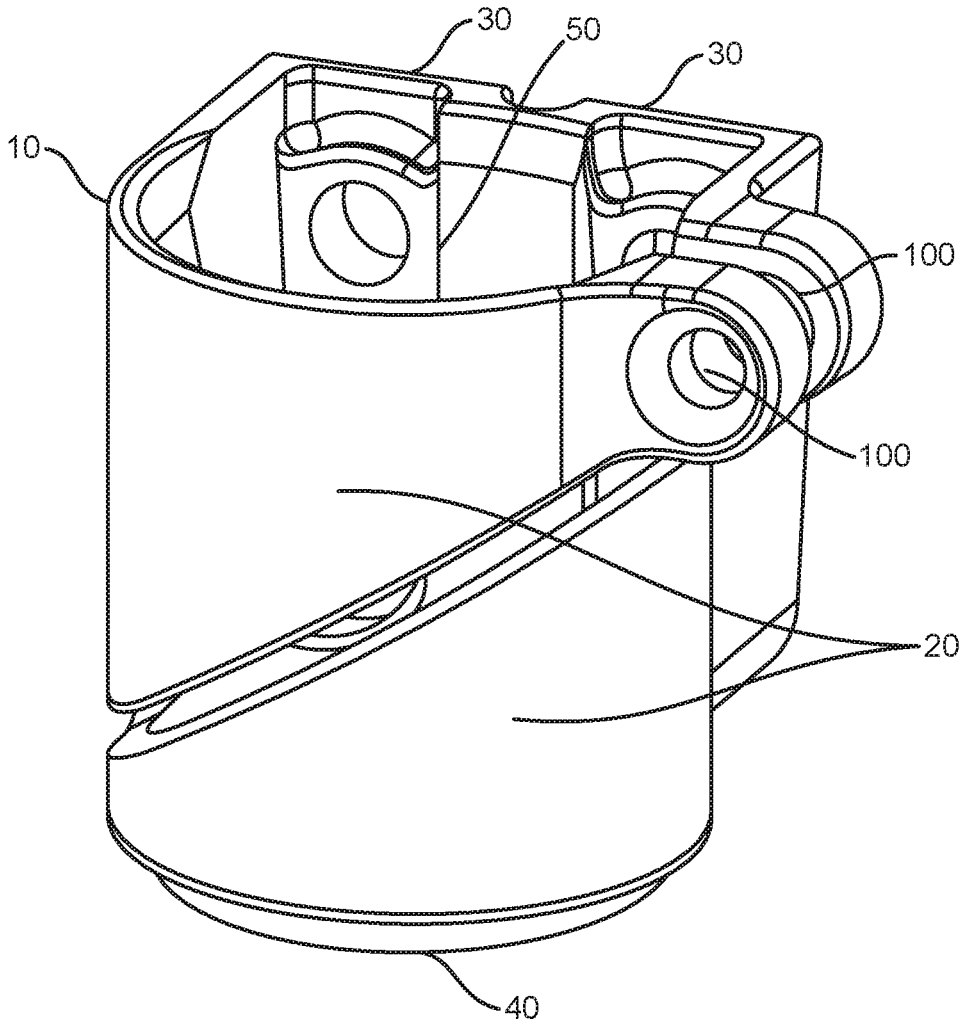
FIG. 1 is a perspective view of the preferred embodiment of the adjustable holder.

Turning to FIGS. 1-5, the preferred embodiment of the device comprises a substantially cylindrical casing 10 having a curved frontal wall 20 connected to an opposing substantially flat back wall 30, a closed bottom end 40 and open top end 50, all of which define an interior compartment. The interior compartment is sized and dimensioned to accommodate various substantially cylindrical objects (e.g., including but not limited to, a flashlight, water bottle, baton, cylindrical flash bangs or grenades, and aiming scopes).

Figure 2:
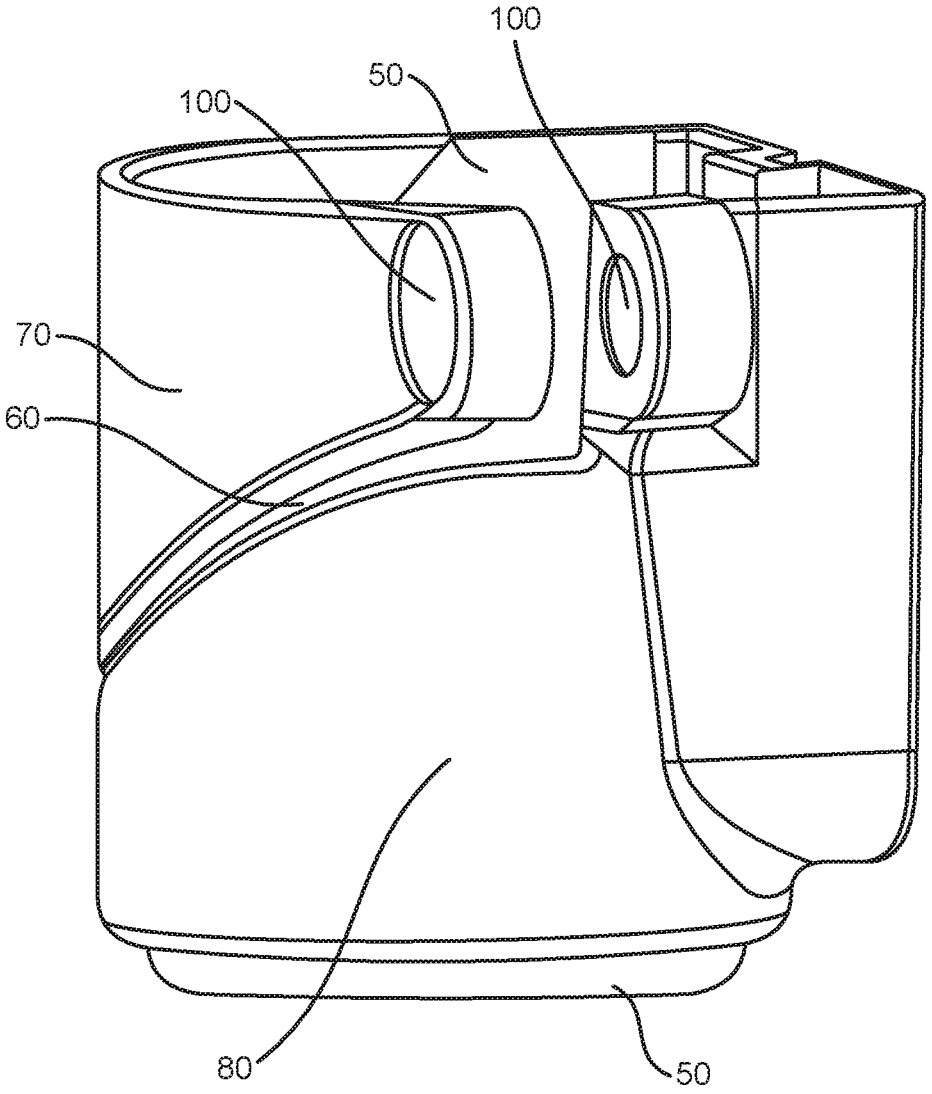
FIG. 2 is a profile view of the preferred embodiment of the adjustable holder.
Figure 3:
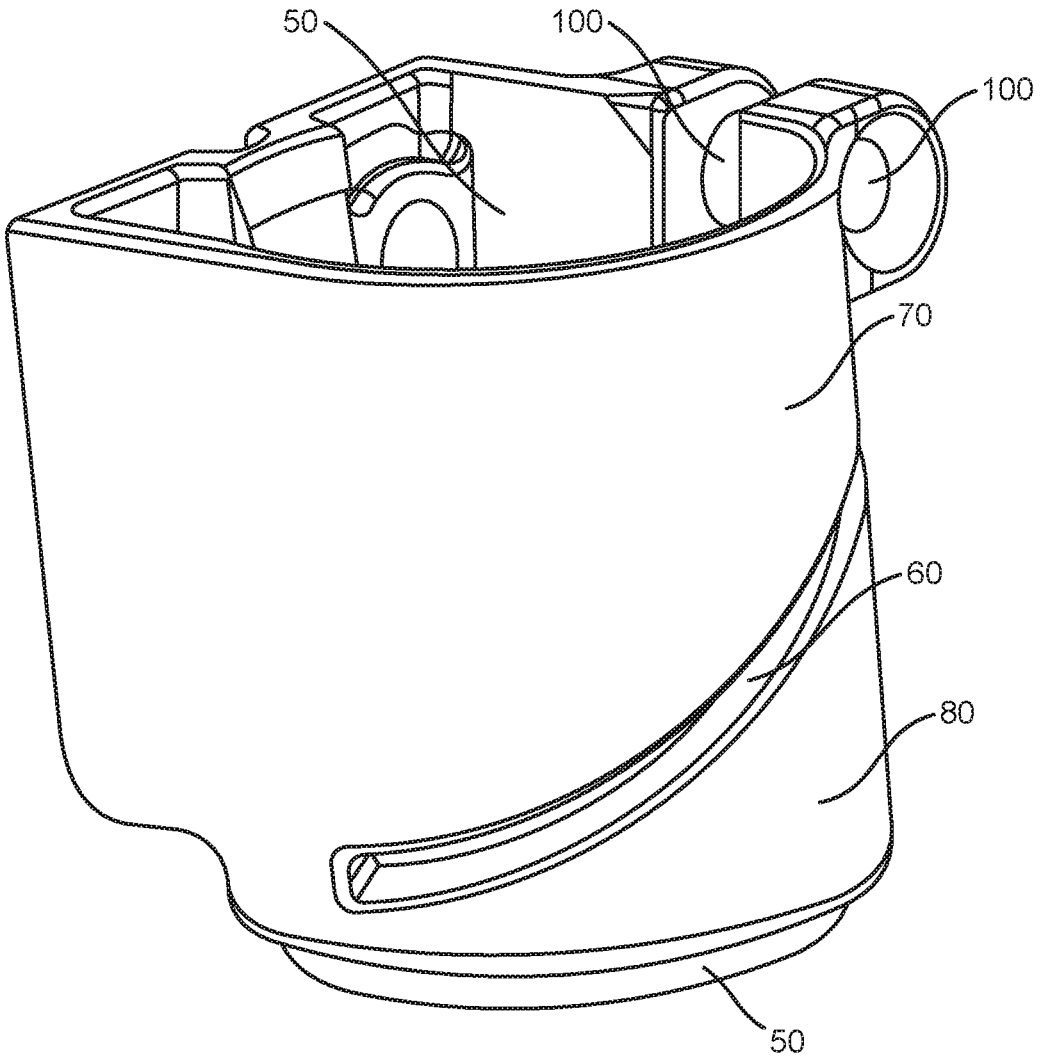
FIG. 3 is an alternative perspective view of the preferred embodiment of the adjustable holder.

Turning to FIGS. 2 and 3, the cylindrical casing 10 further comprises a helical opening 60 that separates the frontal wall 20 of the casing 10 into two portions, an upper portion 70 and a lower portion 80. The helical opening 60 runs along the frontal wall 20 of the casing 10 and terminates prior to reaching the bottom end 40 of the casing 10. The upper portion 70 and lower portion 80 are connected by at least one fastener sized and dimensioned to fit within molded apertures 100 protruding from the exterior surface of the upper 70 and lower 80 portions near the top end 50 of the casing 10, such that the two apertures 100 are in substantial alignment.

Figure 4:
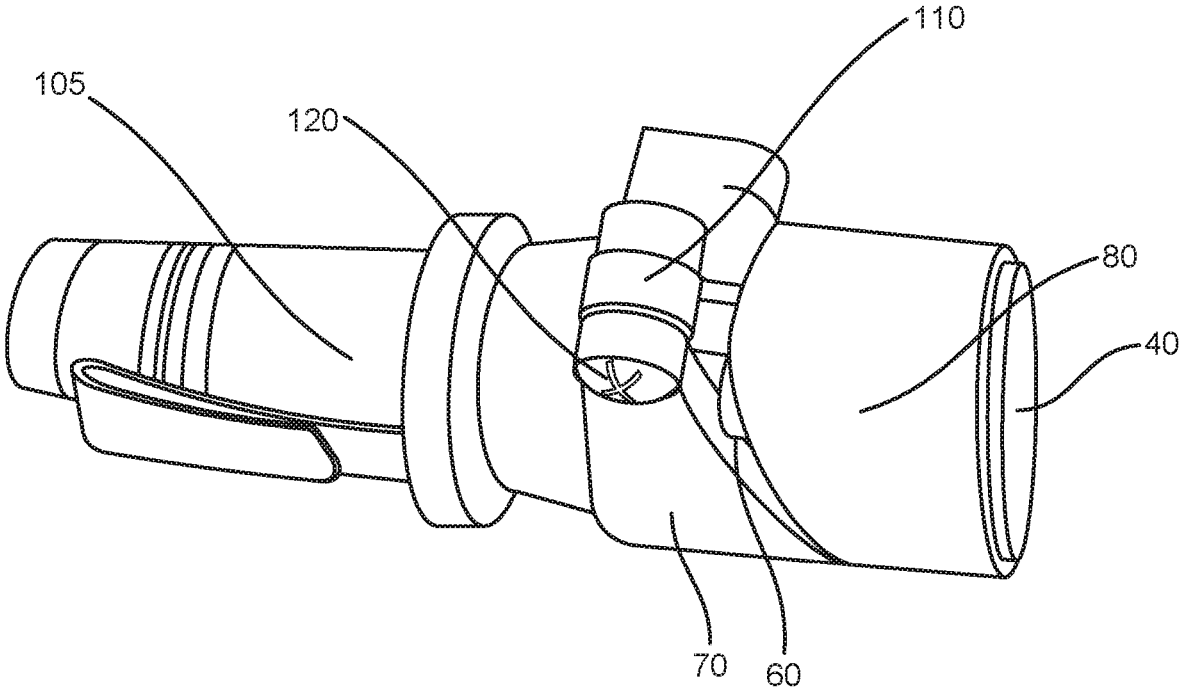
FIG. 4 is an alternative perspective view of the preferred embodiment of the adjustable holder showing a cylindrical flashlight head inserted into the holder.

FIG. 4 shows the adjustable holder securing a cylindrical flashlight 105. The apertures 100 (as shown in FIGS. 1-3) are configured, sized and dimensioned to accommodate a fastener, including but not limited to, a screw or nut 110 and bolt 120 fastening system (as shown in FIG. 4) in order to connect the upper 70 and lower 80 portion of the casing 10. When the screw or bolt 120 is tightened, or rotated in a clockwise direction, the upper portion 70 and lower portion 80 will be forced to rotate in opposite directions around the vertical axis of the casing, which will reduce the diameter of the interior compartment within the cylindrical casing 10, similar to the effect of wringing a towel. The torqueing of both the upper portion 70 and lower portion 80 in opposite directions relative to a fixed base results in an a more efficient reduction of the diameter of the interior compartment in proportion to the rotations of the fastener 90. Similarly, when the screw or bolt 120 is loosened, or rotated in a counter-clockwise direction, the result is a more efficient widening of the diameter of the interior compartment. The flexibility of the device being able to efficiently expand and retract the diameter of its interior compartment allows substantially cylindrical objects of various diameters and sizes to fit tightly and securely within the device.

Figure 5:
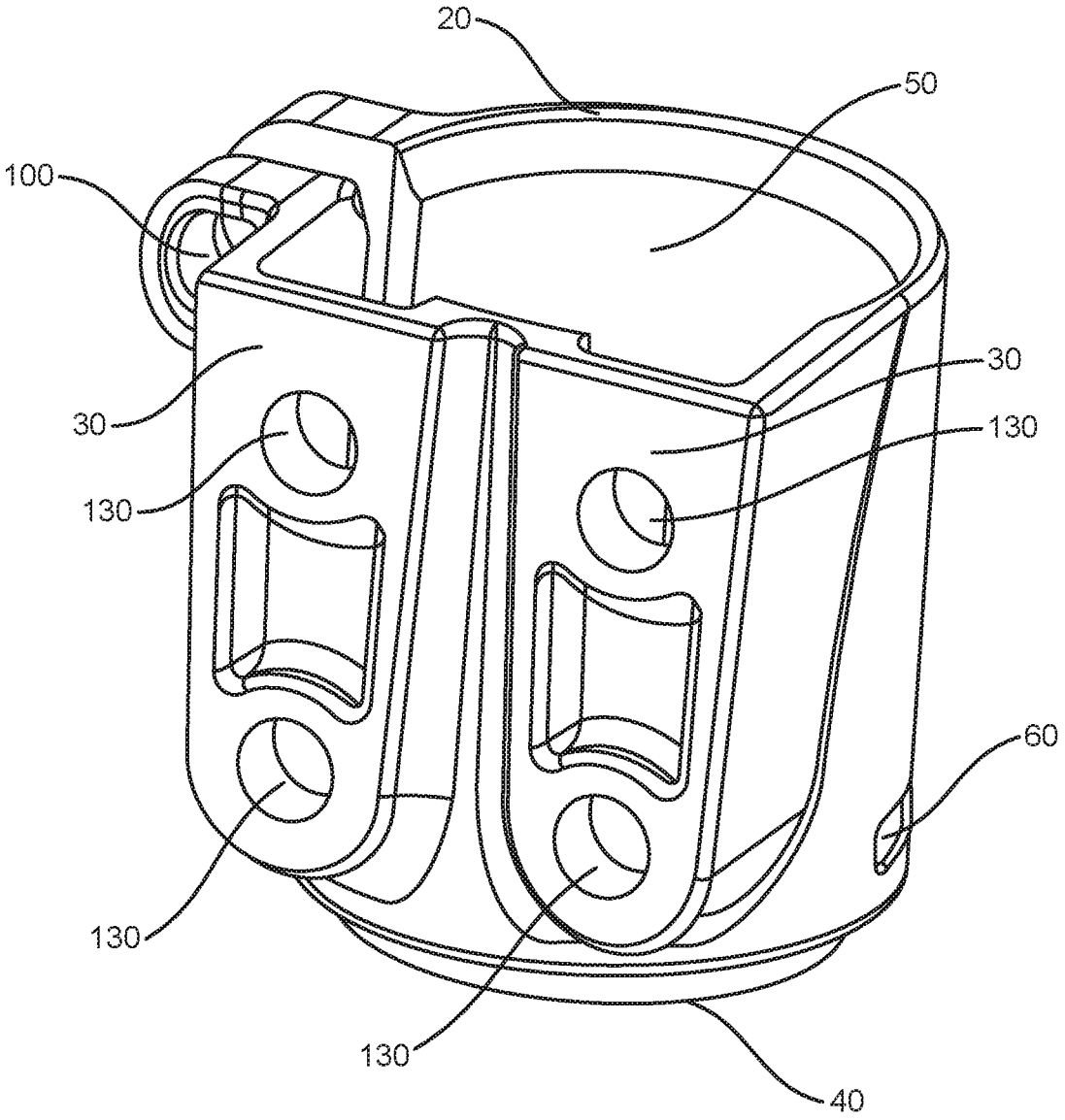
FIG. 5 is an alternative perspective view of the preferred embodiment of the adjustable holder showing the back wall of the holder.

Turning to FIG. 5, the back wall 30 of the cylindrical casing 10 further comprises a plurality of molding mounting apertures 130 that enhance the scope and usefulness of the invention enabling it to be completely modular, useable with an entire family of mounting accessories. Such accessories include but are not limited to: paddles, clips, belt loops, MOLLE (modular, lightweight load-carrying equipment) attachment devices, leg mounts, vest carry, harness carry, etc. Further the molded mounting apertures 130 allow stacking and attaching and fastening together of identical or similar devices, organized in various combinations so as to be adaptable to the user's mission, operational environment, needs, training and/or preference.

For the purposes of promoting an understanding of the principles of the invention, reference has been made to the preferred embodiments illustrated in the drawings, and specific language has been used to describe these embodiments. However, this specific language intends no limitation of the scope of the invention, and the invention should be construed to encompass all embodiments that would normally occur to one of ordinary skill in the art. The particular implementations shown and described herein are illustrative examples of the invention and are not intended to otherwise limit the scope of the invention in any way. For the sake of brevity, conventional aspects of the method (and components of the individual operating components of the method) may not be described in detail. Furthermore, the connecting lines, or connectors shown in the various figures presented are intended to represent exemplary functional relationships and/or physical or logical couplings between the various elements. It should be noted that many alternative or additional functional relationships, physical connections or logical connections might be present in a practical device. Moreover, no item or component is essential to the practice of the invention unless the element is specifically described as "essential" or "critical". Numerous modifications and adaptations will be readily apparent to those skilled in this art without departing from the spirit and scope of the present invention.

What is claimed is:

1. An adjustable holder comprising:

a fastener; and a substantially cylindrical casing comprising: a substantially curved front wall, the substantially curved front wall further comprising two portions and a helical opening, where the helical opening separates the two portions of the substantially curved front wall; an opposing back wall; a closed bottom end; an open top end; and an interior compartment;

wherein the substantially curved front wall is connected to the opposing back wall, the closed bottom is connected to both the substantially curved front wall and the opposing back wall, and the substantially curved front wall, the opposing back wall, and the closed bottom collectively form the interior compartment; and wherein the two portions of the substantially curved front wall are connected by the fastener.

2. The holder of claim 1, wherein the opposing back wall is flat.

3. The holder of claim 1, wherein said helical opening has a width; and wherein the fastener is operable to adjust the width of the helical opening.

4. The holder of claim 1, wherein the fastener is operable to adjust the diameter of the interior compartment.

5. The holder of claim 1, wherein the fastener is a nut and bolt that is secured through apertures.

6. The holder of claim 1 wherein the apertures are threaded.

7. The holder of claim 6, wherein the fastener is a screw that is threaded through the apertures.

8. The holder of claim 1 further comprising molded mounting apertures on the exterior surface of the back wall.

9. The holder of claim 8 wherein the mounting apertures are sized and dimensioned to attach to a mounting accessory.

10. The holder of claim 9 wherein the mounting accessory is selected from the group comprising paddles; clips; belt loops; modular, lightweight load-carrying equipment attachment devices; leg mounts; vest carry devices and harness carry devices.

11. The holder of claim 1 wherein the interior compartment is sized and dimensioned to carry substantially cylindrical products of varying diameters.

12. The holder of claim 11 wherein the cylindrical products are selected from a group comprising flashlight, water bottle, baton, cylindrical flash bang or grenade, and aiming scope.

* * * * *